United States Patent [19]

Schuetz

[11] 4,079,932

[45] Mar. 21, 1978

[54] ATHLETIC CONDITIONING APPARATUS

[76] Inventor: Robert W. Schuetz, 715 Sherman Ave., Cambridge, Ohio 43725

[21] Appl. No.: 785,172

[22] Filed: Apr. 6, 1977

[51] Int. Cl.[2] ..... A63B 5/20

[52] U.S. Cl. ..... 272/75; 215/1 R; 272/122

[58] Field of Search ..... 272/74, 75, 67, 68, 272/116, 117, 118, 119, 120, 122, 123, 124, 143; 43/3; 215/1 R, 1 C, 100 R, 100 A; D9/32, 35

[56] References Cited

U.S. PATENT DOCUMENTS

| | | | |
|---|---|---|---|
| D. 192,978 | 6/1962 | Garvey | 215/1 R |
| D. 194,714 | 2/1963 | Paganelli, Sr. | D9/35 |
| D. 195,896 | 8/1963 | Garvey | 215/1 R |
| D. 205,480 | 8/1966 | Thomte | D9/35 |
| D. 206,496 | 12/1966 | Giessinger | D9/32 |
| D. 210,866 | 4/1968 | Wickham | D9/32 |
| D. 223,601 | 5/1972 | Johnson | 215/1 C UX |
| 2,719,038 | 9/1955 | Massa | 272/124 X |
| 2,978,131 | 4/1961 | Garvey | 215/1 R |
| 3,115,721 | 12/1963 | Story | 43/3 |
| 3,334,899 | 8/1967 | Bosko et al. | 272/122 |

FOREIGN PATENT DOCUMENTS

| | | | |
|---|---|---|---|
| 482,724 | 1/1917 | France | 215/100 A |

OTHER PUBLICATIONS

"Rumhound" Bottle, New Yorker Magazine, Dec. 4, 1948, p. 139.

*Primary Examiner*—Richard J. Apley
*Assistant Examiner*—Arnold W. Kramer
*Attorney, Agent, or Firm*—Strauch, Nolan, Neale, Nies & Kurz

[57] ABSTRACT

A total body conditioning apparatus in the form of a pair of independent adjustable weight members having integral handles and means for attaching a skipping rope. Each exercise member has a chamber to which water or other fluent material is added in a predetermined weight amount suitable for the user.

3 Claims, 4 Drawing Figures

FIG. 1
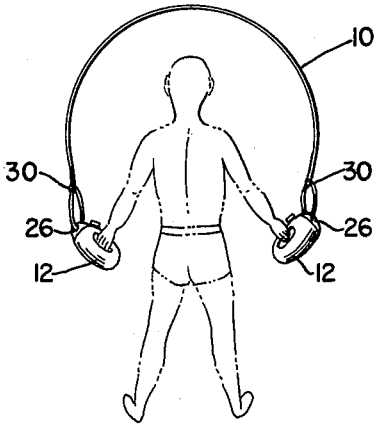
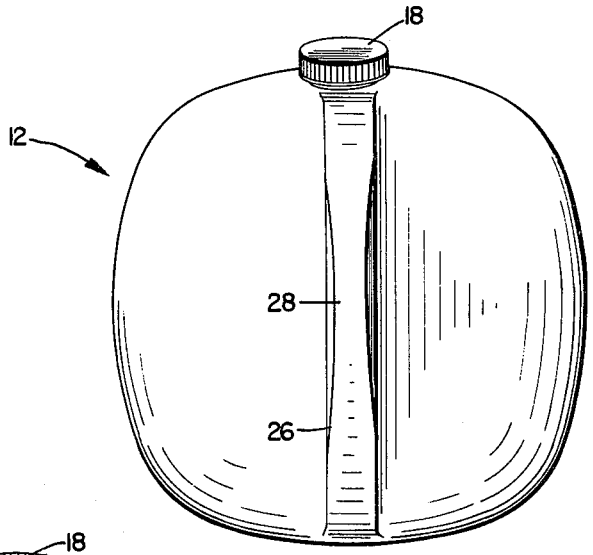
FIG. 2
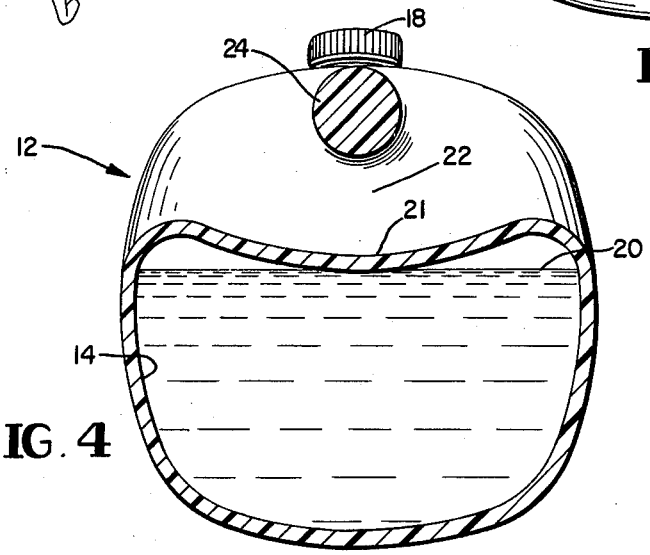
FIG. 4
FIG. 3
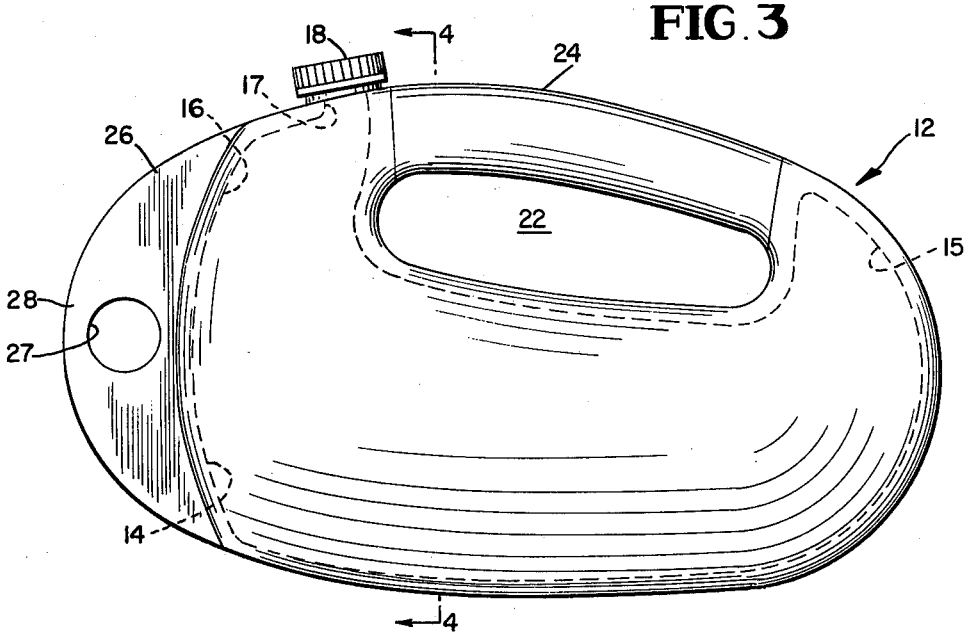

ATHLETIC CONDITIONING APPARATUS

BACKGROUND OF THE INVENTION

The prior art includes a variety of adjustable weight barbells, dumbbells, and the like as well as a number of variations of the well-known jump rope, or skipping rope.

Representative disclosures of exercise weights are found in U.S. Pat. Nos. 1,138,196; 1,366,200; 1,422,888; 1,917,566; 3,311,374; 3,334,899 and 3,756,597, Similarly, the prior art discloses a number of variations of the basic conventional jumping or skipping rope. For example, U.S. Pat. No. 1,010,015 discloses a handled skipping rope made as a flexible spring and U.S. Pat. No. 2,719,038 discloses a skipping rope having variable weight handles.

None of these prior proposals, however, offer the advantages of the present invention in terms of balance, convenience, flexibility of use and application, safety, reduced cost of manufacture, and attractive appearance.

SUMMARY OF THE INVENTION

Accordingly, the principal purpose and object of the present invention is to provide improved, variable weight exercise devices, affording improved balance, versatility and flexibility of application, and having a smooth, curved exterior configuration to provide a safe and attractive unit.

It is a further object of the invention to provide an improved exercising device including a skipping rope with variable weighted handles and having a readily adjustable length rope.

It is also an object of the present invention to provide a weighted handle skipping rope wherein each handle and weight is formed as an integral one-piece handled chamber having a sealable inlet through which a predetermined amount of water or similar material may be introduced to properly weight the handle.

It is yet another object of the invention to provide a weighted handle skipping rope having a ring on each weighted handle for attachment of the rope, the ring being so configured that the rope will not bind in the handle during use of the device, thus eliminating any need for any swivel connection or device for attaching the skipping rope to the weighted handle.

Further novel features and other objects of this invention will become apparent from the following detailed description, discussion and the appended claims taken in conjunction with the accompanying drawings.

BRIEF DESCRIPTION OF DRAWINGS

FIG. 1 is a view of the exercise device of the present invention in use as a skipping rope;

FIG. 2 is a front elevation view of one of the exercise devices with the skipping rope removed, and drawn to an enlarged scale;

FIG. 3 is a side elevation view of one of the exercise devices; and

FIG. 4 is a section view taken along line 4—4 of FIG. 3.

DESCRIPTION OF THE PREFERRED EMBODIMENT

The total body conditioning exercising device is relatively uncomplicated in structure, and includes in one form weights 12 to which a skipping rope 10 may be attached. Each weight 12 is preferably blow molded and fabricated from impact resistant plastic in the general configuration of an oblate spheroid, having a main interior chamber 14 with upstanding rear and front extensions 15 and 16, respectively. The extension 16 has an opening 17 which is sealed by a cap 18.

Thus, before use, each chamber 14 is filled with a measured quantity of water, shown at 20 in FIG. 4. The quantity of water added assures that each weight 12 is weighted properly for the user, considering such factors as size, weight, height, general health and state of physical development. Of course, other fluent material such as sand or lead shot might be introduced to chambers 14, if preferred. In a typical case the unit is so sized as to weigh about five pounds when filled.

The upper surface 21 of the main chamber is concave to form a finger opening 22 beneath a solid handle 24 which extends longitudinally of the device over the center of mass between the body extensions 15 and 16 so that the unit is essentially balanced both laterally and longitudinally.

It will be noted that because of the relationship of the handle 24 to the chamber 14 the balance of the unit is retained despite variations in the quantity of fluid in the chamber. The front or nose portion of each weighted handle 12 includes an integrally formed extension or ring portion 26 having an opening 27 through which skipping rope 10 is threaded. As can be best seen in FIGS. 2 and 3, extension 26 is smoothly tapered into the main body of weighted handle 12 and has a reduced thickness front end 28. This configuration permits the device to be used without causing the skipping rope 10 to bind and accordingly eliminates the need for a special swivel connection.

Skipping rope 10 is adjustable in length as each rope end is inserted through opening 27 in extension 26 and then merely tied to the main body of rope 10 as shown at knot 30 in FIG. 1. Either one or both knots 30 may be slid along rope 10 to adjust its length or the rope may be retied. Further, the relatively large loops formed in each end of rope 10 as shown assist in further reducing the possibility of the rope binding within extension 26 when the exercising device is used.

A specific exercise program exploying the athletic conditioning device disclosed and claimed herein will have significant beneficial effects. The skipping exercise is, of course, particularly beneficial in developing coordination and improved breathing performance. The balanced weight provided by the weighted handles is transferred from the hands through the arms and the rest of the body to more readily develop strength, power and endurance.

The weights of the present invention are smoothly contoured and are entirely free of sharp corners or projections and thus are particularly adapted for the use in rapid vigorous exercises without risk of injury.

The invention may be embodied in other specific forms without departing from the spirit or essential characteristics thereof. The present embodiment is therefore to be considered in all respect as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A variable weight exercise device comprising a hollow main body portion forming a single continuous elongated chamber having upstanding end portions adapted to contain a selected quantity of fluent material, said main body portion having a botttom wall, side walls and a top wall, each of said walls merging into the adjacent walls in a smoothly curved wall portion, said upstanding end portions of said main body having continuously curved exterior surfaces, a handle extending longitudinally of said main body portion between said upstanding end portions and midway of the side walls of said main body portion, an extension projecting perpendicularly from one of said upstanding end portions centrally thereof having a through opening essentially normal to the longitudinal axis of said main body portion for attachment of a skipping rope and a sealable opening communicating with said main body portion.

2. The exercise device according to claim 1, wherein said extension has essentially planar side surfaces and a continuously curved endface forming a smooth continuation of said one upstanding end portion.

3. An exercise device comprising a pair of identical variable weights, each of said weights comprising a hollow main body portion forming a single continuous elongated chamber having upstanding end portions adapted to contain a selected quantity of fluent material, said main body portion having a bottom wall, side walls, and a top wall, each of said walls merging into the adjacent walls in a smoothly curved wall portion, said upstanding end portions of said main body having continuously curved exterior surfaces, a handle extending longitudinally of said main body portion between said upstanding end portions and mid-way of the side walls of said main body portion, a sealable opening communicating with said main body portion, an extension projecting perpendicularly from one of said upstanding end portions centrally thereof having a through opening essentially normal to the longitudinal axis of said main body portion, and a skipping rope, the opposite ends of which extend through the openings on the respective weights for attachment thereto.

* * * * *